US012668347B2

(12) United States Patent
Ito

(10) Patent No.: US 12,668,347 B2
(45) Date of Patent: Jun. 30, 2026

(54) STEERING CONTROL DEVICE THAT MAKES CONTROL OF A STEERING MODE OF MARINE VESSEL, METHOD THEREOF, AND MARINE VESSEL

(71) Applicant: YAMAHA HATSUDOKI KABUSHIKI KAISHA, Iwata (JP)

(72) Inventor: Takuma Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 152 days.

(21) Appl. No.: 18/738,090

(22) Filed: Jun. 10, 2024

(65) Prior Publication Data

US 2024/0425167 A1 Dec. 26, 2024

(30) Foreign Application Priority Data

Jun. 21, 2023 (JP) ..... 2023-101381

(51) Int. Cl.
*B63H 25/04* (2006.01)
*B63H 25/02* (2006.01)

(52) U.S. Cl.
CPC ..... *B63H 25/04* (2013.01); *B63H 2025/022* (2013.01)

(58) Field of Classification Search
CPC ..... B63H 25/04; B63H 2025/022
USPC ..... 701/21
See application file for complete search history.

(56) References Cited

U.S. PATENT DOCUMENTS

| | | | | |
|---|---|---|---|---|
| 9,733,645 | B1 * | 8/2017 | Andrasko | B63H 25/02 |
| 9,809,292 | B1 * | 11/2017 | Gonring | G05D 1/0206 |
| 11,091,243 | B1 * | 8/2021 | Gable | B63H 25/46 |
| 2005/0064770 | A1 * | 3/2005 | Roos | B63H 11/113 440/40 |
| 2015/0089427 | A1 | 3/2015 | Akuzawa | |
| 2021/0053665 | A1 | 2/2021 | Fujino et al. | |
| 2023/0150642 | A1 | 5/2023 | Watanabe et al. | |

FOREIGN PATENT DOCUMENTS

| | | | |
|---|---|---|---|
| JP | 1-141198 | A | 6/1989 |
| JP | 2015-66979 | A | 4/2015 |

OTHER PUBLICATIONS

Official Communication issued in corresponding European Patent Application No. 24181964.8, mailed on Dec. 9, 2024, 7 pages.

* cited by examiner

*Primary Examiner* — Tiffany P Young
(74) *Attorney, Agent, or Firm* — Keating & Bennett, LLP

(57) ABSTRACT

A steering control device for a marine vessel that cancels an automatic steering mode by a rotation operation of a steering wheel includes a controller to perform a control to shift to the automatic steering mode when acquiring a start instruction in a normal steering mode, and to shift to the normal steering mode when a rotation angle position of the steering wheel changes beyond a threshold angle in the automatic steering mode. However, in the normal steering mode, the controller does not shift to the automatic steering mode even when acquiring the start instruction when a difference between an acquired rotation angle position of the steering wheel and a first angle position is smaller than a first predetermined amount, or when a difference between the acquired rotation angle position and a second angle position is smaller than a second predetermined amount.

14 Claims, 8 Drawing Sheets

STEERING CONTROL DEVICE THAT MAKES CONTROL OF A STEERING MODE OF MARINE VESSEL, METHOD THEREOF, AND MARINE VESSEL

CROSS REFERENCE TO RELATED APPLICATIONS

This application claims the benefit of Japanese Patent Application No. 2023-101381, filed Jun. 21, 2023, which is hereby incorporated by reference herein in its entirety.

BACKGROUND OF THE INVENTION

1. Field of the Invention

The present invention relates to steering control devices that control steering modes of marine vessels, methods thereof, and marine vessels including steering devices.

2. Description of the Related Art

Some marine vessels have an automatic steering mode in which a course is automatically controlled without a steering operation. Generally, a shift to the automatic steering mode is performed by inputting a start instruction of the automatic steering mode. On the other hand, Japanese Laid-open Patent Publication (Kokai) No. H01-141198 and Japanese Laid-open Patent Publication (Kokai) No. 2015-66979 disclose cancellation of the automatic steering mode.

In Japanese Laid-open Patent Publication (Kokai) No. H01-141198, the automatic steering mode is canceled when a vessel speed or an engine rotation speed is higher than a predetermined value. In Japanese Laid-open Patent Publication (Kokai) No. 2015-66979, the automatic steering mode is canceled when a rotation operation of steering wheel by a predetermined rotation angle or more is input.

On the other hand, there is a marine vessel in which a rotatable angle of a steering wheel is limited. In such a marine vessel, it is conceivable that the automatic steering mode is configured to be canceled by a rotation operation of the steering wheel.

A case is conceivable that, after a steering mode is shifted to the automatic steering mode in a state in which the rotation angle position of the steering wheel is in the vicinity of one rotation limit position, a vessel user rotates the steering wheel in the same rotation direction with the intention of canceling the automatic steering mode. However, in this case, the steering wheel does not rotate beyond the one rotation limit position described above. Therefore, even when the vessel user tries to rotate the steering wheel, the steering wheel does not rotate, and the automatic steering mode may not be canceled as intended.

SUMMARY OF THE INVENTION

Example embodiments of the present invention provide steering control devices for marine vessels and methods thereof, and marine vessels including the steering devices to cancel an automatic steering mode by a rotation operation of a steering wheel at any time.

According to an example embodiment of the present invention, a steering control device for a marine vessel including a steering wheel having a rotatable angle in a left rotation direction limited to a first angle position, and a rotatable angle in a right rotation direction limited to a second angle position, the marine vessel including steering modes including a normal steering mode and an automatic steering mode, the steering control device including at least one memory to store a set of instructions, and at least one processor configured or programmed to execute the set of instructions to acquire a rotation angle position of the steering wheel, acquire a start instruction of the automatic steering mode to allow the marine vessel to be automatically steered without depending on a rotation operation of the steering wheel, and perform a control operation to shift the steering mode to the automatic steering mode in response to acquisition of the start instruction in the normal steering mode, and to shift the steering mode to the normal steering mode in response to a change in the rotation angle position of the steering wheel beyond a threshold angle in the automatic steering mode, wherein during the control operation, in the normal steering mode, the at least one processor is configured or programmed to not shift the steering mode to the automatic steering mode even when the start instruction is acquired in a case where a difference between the acquired rotation angle position of the steering wheel and the first angle position is smaller than a first predetermined angle amount, or in a case where a difference between the acquired rotation angle position of the steering wheel and the second angle position is smaller than a second predetermined angle amount.

According to this configuration, a steering wheel has a rotatable angle in a left rotation direction limited to a first angle position, and a rotatable angle in a right rotation direction limited to a second angle position. A control operation is performed to shift a steering mode to an automatic steering mode in response to acquisition of a start instruction of the automatic steering mode in a normal steering mode, and to shift the steering mode to the normal steering mode in response to a change in a rotation angle of the steering wheel beyond a threshold angle in the automatic steering mode. However, in the normal steering mode, the steering mode is not shifted to the automatic steering mode even if the start instruction is acquired in a case where a difference between an acquired rotation angle position of the steering wheel and the first angle position is smaller than a first predetermined angle amount, or in a case where a difference between the acquired rotation angle position of the steering wheel and the second angle position is smaller than a second predetermined angle amount.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Hereinafter, example embodiments of the present invention will be described with reference to the drawings.

Figure 1:
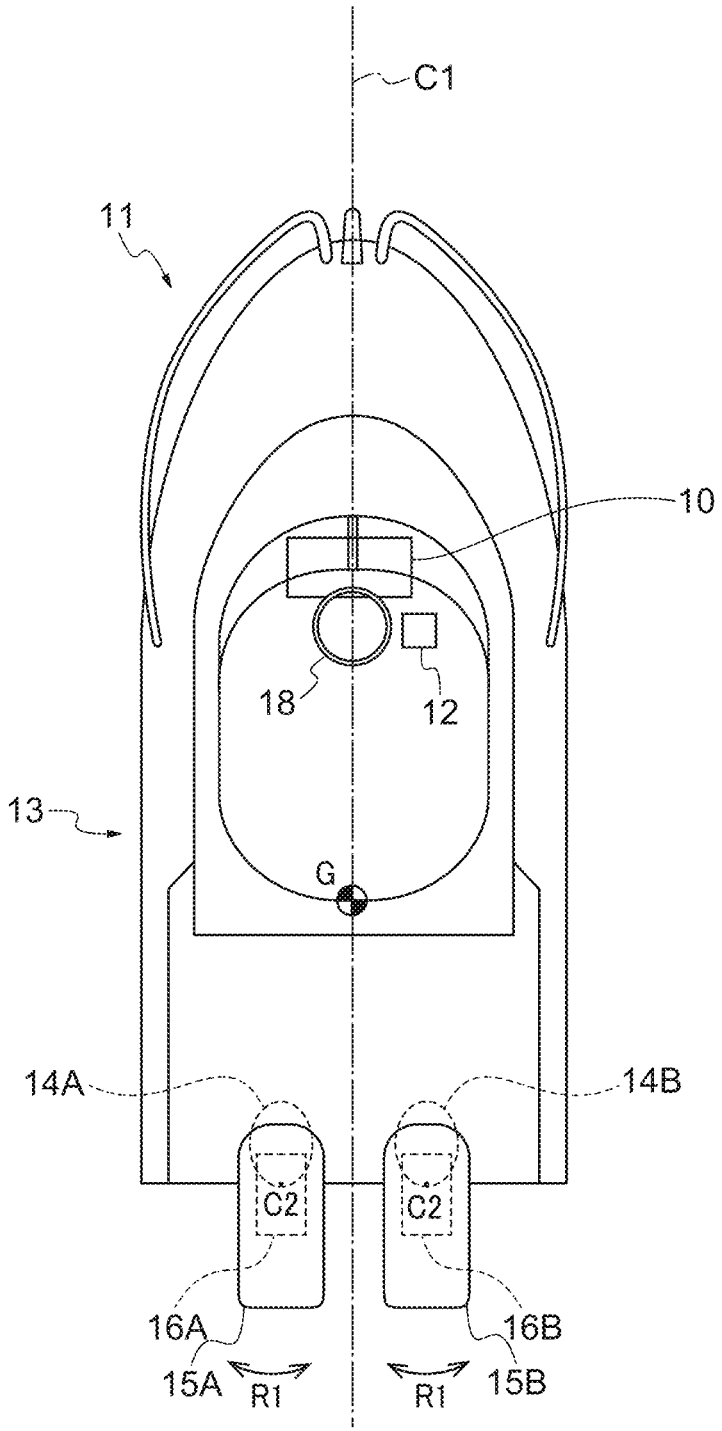
FIG. 1 is a top view of a marine vessel to which a steering control device is applied.

FIG. 1 is a top view of a marine vessel 11 to which a steering control device according to an example embodiment of the present invention is applied. A marine vessel 11 includes a hull 13 and a plurality of (for example, a pair of) outboard motors 15 (15A and 15B) each defining a propulsion device that propels the hull 13. A central unit 10, a steering wheel 18, and a remote control unit 12 are provided in the vicinity of a steering seat of the hull 13.

In the following description, "forward", "rearward", "left", "right", "upward", and "downward" directions respectively indicate forward, rearward, left, right, upward, and downward directions of the hull 13. For example, as illustrated in FIG. 1, a center line C1 extending in the forward-and-rearward direction of the hull 13 passes through the center of gravity G of the marine vessel 11. The forward-and-rearward direction is a direction parallel to the center line C1. The front side ("forward") is a direction oriented upwards along the center line C1 in the drawing of FIG. 1. The rear side ("rearward") is a direction oriented downwards along the center line C1 in the drawing of FIG. 1. The "left"-and-"right" direction is defined by left-and-right of a case in which the hull 13 is viewed from the rear side. The "upward"-and-"downward" direction is a direction perpendicular to the forward-and-rearward direction and to the left-and-right direction.

The two outboard motors 15 are mounted side by side at the stern of the hull 13. When the two outboard motors 15 are distinguished from each other, the one disposed on the port side is referred to as an "outboard motor 15A", and the other one disposed on the starboard side is referred to as an "outboard motor 15B". Each of the outboard motors 15A and 15B is attached to the hull 13 via an attachment unit 14 (14A and 14B). Each of the outboard motors 15A and 15B includes an engine 16 (16A, 16B) serving as a drive source.

Each outboard motor 15 obtains a propulsive force by a propeller (not illustrated) rotated by a drive force of the engine 16 corresponding thereto. The attachment units 14, the engines 16, and the like are also referred to as the attachment units 14A and 14B and the engines 16A and 16B, respectively, corresponding to the outboard motors 15A and 15B when distinguished from each other.

The remote control unit 12 includes two throttle levers, and is operated to adjust outputs of the engines 16A and 16B and to perform switching between a forward movement and a rearward movement of the marine vessel. Each throttle lever can be operated in the forward direction and the rearward direction from the zero operation position.

Since the configurations of the outboard motors 15A and 15B are common to each other, one outboard motor 15 will be described. The outboard motor 15 includes the attachment unit 14 to attach an outboard motor main body to the hull 13, and a steering shaft (not illustrated). The steering shaft is provided in the outboard motor main body and is supported by the attachment unit 14. The outboard motor main body is configured to be steerable to the left and right about the steering shaft. The outboard motor main body is attached to the rear portion of the hull 13 via the steering shaft and the attachment unit 14. When the steering wheel 18 is operated, the outboard motor main body turns left and right (R1 direction) about a pivot center C2. As a result, the marine vessel 11 is steered. Further, the outboard motor main body is rotatable about a tilt shaft (not illustrated) via the attachment unit 14.

Figure 2:
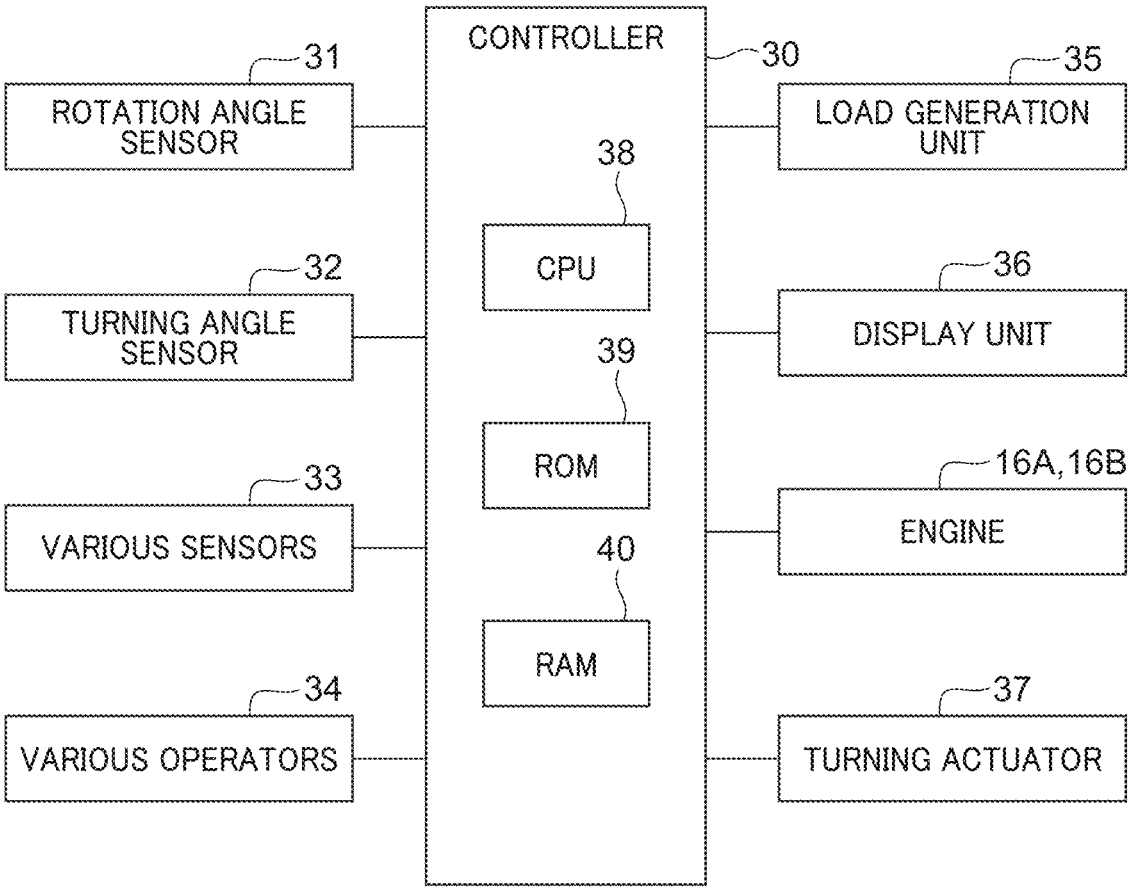
FIG. 2 is a block diagram of a steering system.

FIG. 2 is a block diagram of a steering system in the marine vessel 11. The steering system includes the steering control device of the present example embodiment.

The steering system includes a controller 30, the engines 16A and 16B, a rotation angle sensor 31, turning angle sensors 32, various sensors 33, various operators 34, a load generation unit 35, a display unit 36, and a turning actuator 37.

The controller 30 includes a CPU 38, a ROM 39, a RAM 40, and a timer (not illustrated). The ROM 39 stores a control program. The CPU 38 implements various types of control processes by loading the control program stored in the ROM 39 in the RAM 40 and executing the control program. The RAM 40 provides a work area used when the CPU 38 executes the control program.

The turning actuator 37 is provided for each of the outboard motors 15A and 15B. The turning actuator 37 rotates the corresponding outboard motor 15 with respect to the hull 13 about the pivot center C2 (in FIG. 1). Therefore, the turning actuator 37 defines and functions as a turning driver to change the turning angle of the corresponding outboard motor 15. A direction in which propulsive force acts can be changed with respect to the center line C1 of the hull 13 by each of the outboard motors 15A and 15B being rotated about the pivot center C2.

The turning angle sensor 32 is provided for each of the outboard motors 15A and 15B and detects an actual turning angle of the corresponding outboard motor 15A and an actual turning angle of the corresponding outboard motor 15B. It is noted that the controller 30 may acquire the actual turning angle from a steering instruction value output to the turning actuator 37.

The rotation angle sensor 31 detects a rotation angle position of the steering wheel 18. The various sensors 33 include a throttle opening sensor, a throttle sensor, an engine rotation speed sensor, a hull speed sensor, a hull acceleration sensor, an azimuth sensor, a distance sensor, a posture sensor, a position sensor, a GPS sensor, and the like. Detection signals from the rotation angle sensor 31 and the various sensors 33 are supplied to the controller 30. The throttle opening sensor and the engine rotation speed sensor are provided in each corresponding outboard motor 15. The hull speed sensor, the hull acceleration sensor, the azimuth sensor, the distance sensor, the posture sensor, and the position sensor are, for example, included in the central unit 10 or disposed in the vicinity of the central unit 10.

The engine rotation speed sensor detects a rotation speed, which is revolutions per unit period of time, of the corresponding engine 16. The throttle opening sensor detects an opening of a throttle valve (not illustrated). The hull speed sensor detects a navigation speed (vessel speed) of the marine vessel 11 (hull 13). The hull acceleration sensor detects acceleration of the marine vessel 11 (hull 13). The posture sensor includes, for example, a gyro sensor, a magnetic azimuth sensor, and the like. It is noted that the vessel speed and the hull acceleration may be acquired from a GPS signal received by the GPS sensor.

The various operators 34 include an operator to perform an operation related to steering, a setting operator to perform various settings, and an input operator to input various instructions. The various operators 34 are included in the central unit 10 or disposed in the vicinity of the central unit 10. Some of the various operators 34 may be disposed on the steering wheel 18. The various operators 34 are operated by a vessel user, and operation signals thereof are supplied to the controller 30.

It is noted that the controller 30 may establish predetermined communication with the rotation angle sensor 31, the turning angle sensor 32, the various sensors 33, the various operators 34, and the like to exchange information. The display unit 36 displays various types of information.

The load generation unit 35 includes, for example, an electromagnetic brake that generates a load in response to a rotation operation of the steering wheel 18. For example, when the electromagnetic brake is in the non-energized state, a rotational load is very small or zero compared to rotational torque of the steering wheel 18, whereas when the electromagnetic brake is in the energized state, the rotational load is large, and a large rotational load acts on the rotation operation of the steering wheel 18. It is noted that the load generation unit 35 may have any configuration as long as the configuration generates a load acting on the rotation operation of the steering wheel 18, and another configuration other than the electromagnetic brake may be used as the load generation unit 35.

It is noted that the steering system may further include a power trim and tilt mechanism (PTT mechanism) that rotates the outboard motor 15 about a tilt axis, a trim tab actuator that drives a tab body, and/or the like.

It is noted that the controller 30 may control each engine 16 via an outboard motor ECU (not illustrated) provided in each outboard motor 15. It is noted that it is not essential to include all the sensors described above.

Figure 3:
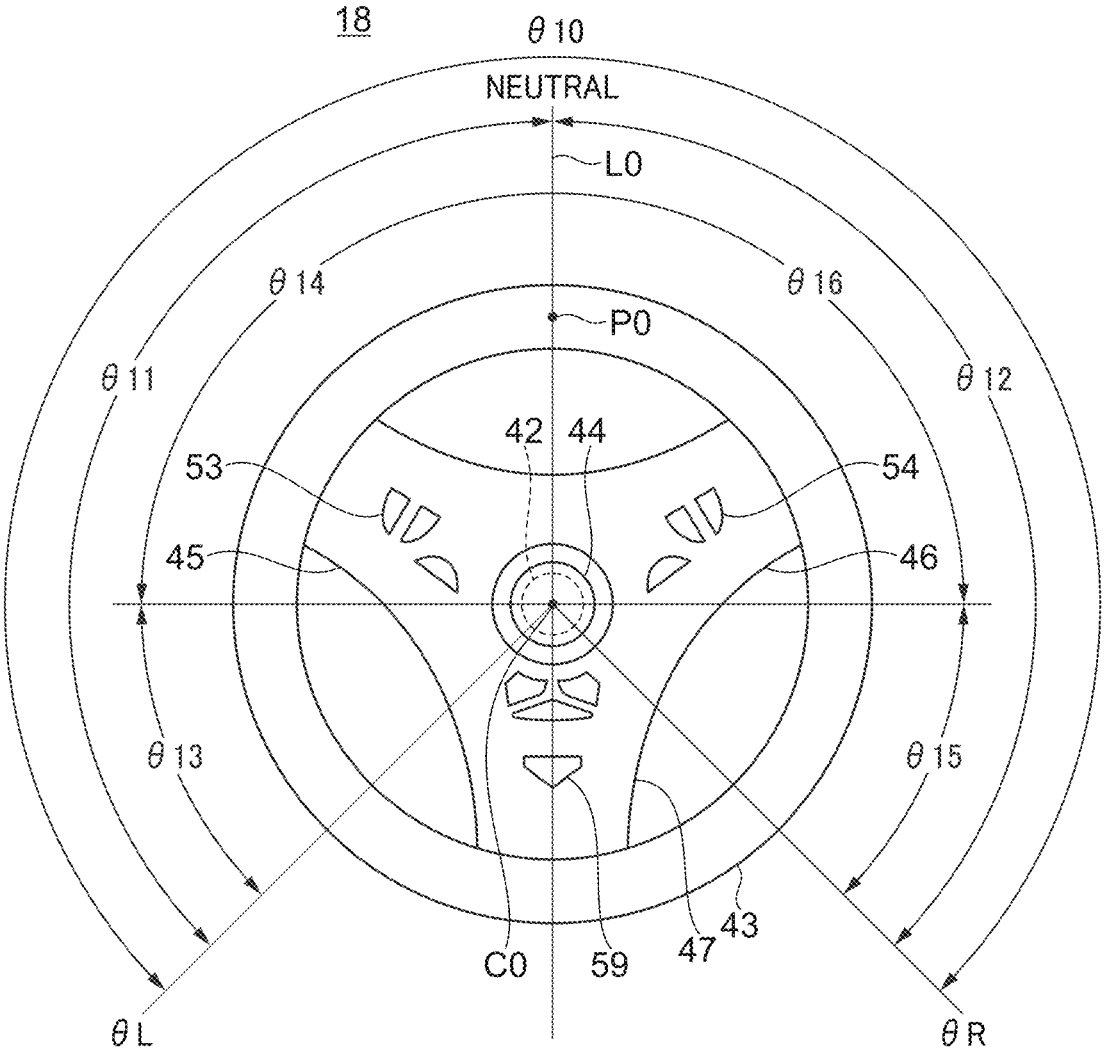
FIG. 3 is a diagram illustrating a steering wheel substantially viewed from the front.

FIG. 3 is a diagram illustrating the steering wheel 18 substantially viewed from the front. The steering wheel 18 includes a central portion 44, an annular wheel portion 43, and three spoke portions (a first spoke portion 45, a second spoke portion 46, and a third spoke portion 47). The steering wheel 18 is supported by the hull 13 so as to be rotatable about a rotation fulcrum C0 which is an axial line of a steering shaft 42.

As viewed in the axial direction of the rotation fulcrum C0, a virtual straight line passing through the center position of the third spoke portion 47 in the width direction and the rotation fulcrum C0 is referred to as a "virtual straight line L0". A rotatable angle of the steering wheel 18 is finite, and a concept of a "neutral position" exists in a rotation range. In FIG. 3, the steering wheel 18 is located at the neutral position. When the steering wheel 18 is located at the neutral position, a point P0 on the virtual straight line L0 in the wheel portion 43 is located immediately above the rotation fulcrum C0 when viewed from the front. The neutral position is a rotational position of the steering wheel 18 when causing the hull 13 to moved forwards (to go straight).

The steering wheel 18 is rotatable by an angle θ11 to the left and an angle θ12 to the right, from the neutral position thereof. The angles θ11 and θ12 are both 135°. That is, with the neutral position as a reference, a rotatable angle θ10 of the steering wheel 18 is limited to a first angle position θL, which is a rotation end position in the left rotation direction, and is limited to a second angle position θR, which is a rotation end position in the right rotation direction. As an example, on the assumption that the rotation angle position of the steering wheel 18 located at the neutral position is zero, the first angle position θL is −135°, and the second angle position θR is +135°.

The significances of a "shift prohibition range" and a "shiftable range" will be described below (in FIG. 4 and subsequent figures). A range from the first angle position θL to an angle position rotated from the first angle position θL by a first predetermined angle amount in the right rotation direction is defined as a shift prohibition range θ13. A range from the second angle position θR to an angle position rotated from the second angle position θR by a second predetermined angle amount in the left rotation direction is defined as a shift prohibition range θ15. As an example, it is assumed that the first predetermined angle amount and the second predetermined angle amount are both 45°. Therefore, both the shift prohibition ranges θ13 and θ15 are in a range of 45° in the neutral direction from the end position of the rotatable angle θ10. The range of an angle θ14 and an angle θ16 in FIG. 3 are the shiftable range. The angle θ14 and the angle θ16 are both 90°, and thus the shiftable range is 180°.

It is noted that the values of θ10 to θ16 are not limited to the exemplified values. In addition, the value of θ11 and the value of θ12, the value of θ13 and the value of θ15, and the value of θ14 and the value of θ16, may be different from each other.

The steering wheel 18 includes a plurality of switches. For example, a changeover switch 59, a left switch 53, and a right switch 54 are disposed on the surface of the steering wheel 18. These switches are included in the various operators 34 (in FIG. 2).

The steering mode will be described. The steering mode is roughly classified into a "normal steering mode" and an "automatic steering mode". Hereinafter, the automatic steering mode is referred to as an "AP mode". The steering mode is switched every time the changeover switch 59 is pressed.

The normal steering mode is a mode in which steering is performed according to the rotation operation of the steering wheel 18 or the like. For example, in the normal steering mode, the controller 30 controls the rotation speeds and/or the rotation directions of the engines 16L and 16R and the turning angle by the turning actuator 37 in accordance with the operation amount and/or the operation direction of the throttle lever in the remote control unit 12 and the rotation angle position of the steering wheel 18.

The AP mode is a mode in which steering is automatically performed without depending on the rotation operation of the steering wheel 18. For example, the AP mode includes a plurality of types of modes such as lateral movement, oblique movement, and in-situ turning, in addition to "course holding travel" for holding a certain course and "azimuth holding travel" for holding a certain azimuth. The type of the AP mode is designated according to an operation of a setting operator and/or an input operator in the various operators 34. The controller 30 implements a designated type of the AP mode by controlling turning angles, shift positions, engine rotation speeds, and the like of the two outboard motors 15.

It is noted that a predetermined operation may be executed when a predetermined operator of the various operators 34 is operated in the AP mode. For example, the controller 30 may control the hull 13 to temporarily move laterally to the left or right when the left switch 53 or the right switch 54 is operated.

Figure 4:
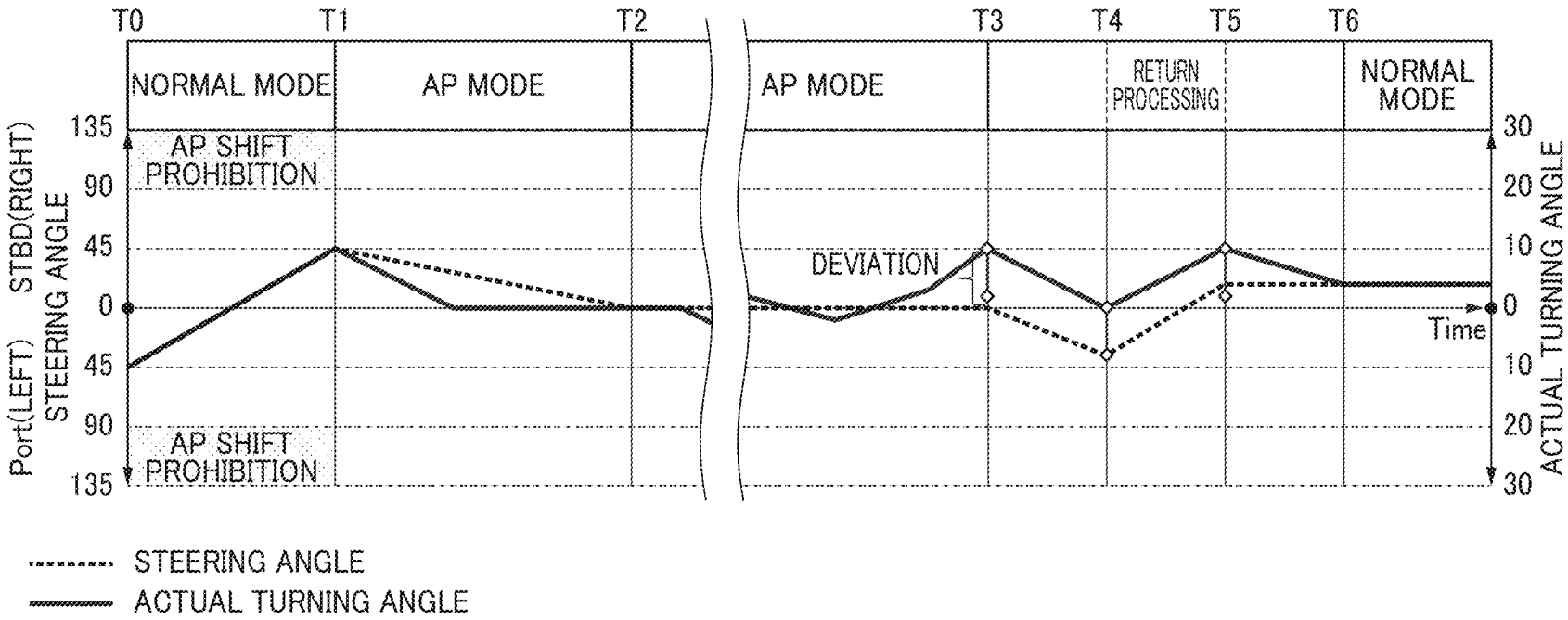
FIG. 4 is a timing chart illustrating a transition of a steering mode.

FIG. 4 is a timing chart illustrating the transition of the steering mode. A horizontal axis represents time. A vertical axis represents a rotation angle position of the steering wheel 18 (hereinafter, also referred to as a "steering angle") and actual turning angles of the outboard motors 15A and 15B. It is noted that, here, since it is assumed that the vessel goes straight in the instructed direction, the actual turning angles (solid lines) of the outboard motors 15A and 15B are common to each other. The steering angle is indicated by a dotted line.

The controller 30 switches the steering mode to the AP mode in response to acquisition of a start instruction of the AP mode by the operation on the changeover switch 59 or the like in the normal steering mode. It is noted that the "normal steering mode" is indicated as a "normal mode" in the drawing. In the AP mode, the controller 30 starts a normal steering mode return processing (return control) in response to a cancellation instruction of the AP mode. There are one or more manners of canceling the AP mode, and a typical manner thereof is to change the steering angle beyond a threshold angle TH (for example, ±10°) so as to cancel the AP mode. This is because when the steering angle is changed beyond the threshold angle TH, it is considered that the vessel user has an intention of resuming manual steering.

Here, the start of the AP mode in the normal steering mode will be described. The controller 30 switches the steering mode to the AP mode in a case where the steering angle is changed so as to fall within the shiftable range (the angle θ14 or the angle θ16) and does not switch the steering mode to the AP mode in a case where the steering angle is changed so as to fall within the shift prohibition ranges θ13 or θ15.

It is assumed that even when the steering angle is within the shift prohibition ranges θ13 or θ15, the steering mode was switched to the AP mode. In this case, there is a possibility that the steering angle cannot be changed beyond the threshold angle TH even if the vessel user intends to resume manual steering in a state in which the steering angle remains the same when the steering mode is switched to the AP mode. For example, when the steering angle is in the vicinity of the left rotation end position, there is little room to further rotate the steering wheel 18 in the left direction. In order to avoid such a case, the shift prohibition ranges θ13 and θ15 are provided.

Referring to FIG. 4, at a time point TO, the normal steering mode is started by starting a system. In response to the start instruction of the AP mode at a time point T1, the start of the AP mode is attempted. In a case where a shift condition to the AP mode is satisfied, such as a case in which the steering angle falls within the shiftable range, the mode is switched to the AP mode. It is noted that details of the processing related to the start of the AP mode including determination of the shift condition to the AP mode will be mainly described below with reference to FIG. 6.

Processing in the AP mode will be mainly described below with reference to FIG. 7. In the AP mode, when the hull 13 comes straight ahead in the instructed direction, the actual turning angle converges to 0. In the AP mode, a notification is provided to return the steering wheel 18 to the neutral position. When the vessel user returns the steering wheel 18 to the neutral position in response to the notification, the steering angle ideally coincides with the actual turning angle (a time point T2).

At a time point T3, cancellation of the AP mode is instructed. At this time point, the steering angle may not coincide with the actual turning angle, that is, there may be deviation between the steering angle and the actual turning angle, for some reason. The controller 30 determines that there is a deviation in a case where there is a predetermined difference or more between the steering angle and the actual turning angle. In a case where there is the deviation, the controller 30 reduces the deviation (time points T3 to T6) and then starts the normal steering mode. The control processing during this period (between the time points T3 to T6) is "return processing" to the normal steering mode (described below mainly with reference to FIG. 8).

In the return processing, when the steering wheel 18 is in the rotationally stopped state (that is, in a case where the steering angle has not been changed beyond the predetermined angle from the time of the previous steering angle acquisition), the controller 30 executes "control during stop (first control)".

The outline will be described. In the control during stop, the controller 30 controls the turning actuator 37 so that the deviation between "the turning angle corresponding to the steering angle" and the actual turning angle becomes small. Here, the "turning angle corresponding to the steering angle" is a turning angle on the instruction determined by the current rotation angle position of the steering wheel 18 when it is assumed that the normal steering mode is set. The deviation between the steering angle and the actual turning angle at the start of the normal steering mode is reduced, and therefore it is possible to suppress an uncomfortable feeling in the steering operation. For example, the control during stop is applied in the time period between the time points T5 and T6, and the deviation is eliminated at a time point T6. As a result, the uncomfortable feeling in the steering operation at the start of the normal steering mode is suppressed without necessity of the rotation operation to reduce the deviation in the AP mode.

On the other hand, in the return processing, when the steering wheel 18 is rotating (that is, in a case where the steering angle has changed beyond the predetermined angle from the time of the previous steering angle acquisition), the controller 30 executes "control during rotation (second control)".

In the control during rotation, a change amount of the actual turning angle corresponding to a rotation amount of the steering wheel 18 is corrected using a relationship between the rotation direction of the steering wheel 18 and the actual turning angle. For example, in a case where "the steering wheel 18 is rotating in a direction in which the turning angle corresponding to the steering angle approaches the actual turning angle", the controller 30 changes the actual turning angle by "a value obtained by correcting the turning angle corresponding to the rotation amount of the steering wheel 18 to a smaller value". This control is applied in the time period between the time point T4 and the time point T5, and a change in the actual turning angle is smaller than a change in the turning angle corresponding to the steering angle. The direction of change between the two is common.

On the other hand, in the control during rotation, in a case where "the steering wheel 18 is rotating in a direction in which the turning angle corresponding to the steering angle is away from the actual turning angle", the controller 30 changes the actual turning angle by "a value obtained by correcting the turning angle corresponding to the rotation amount of the steering wheel 18 to a larger value". This control is applied in the time period between the time point T3 and the time point T4, and a change in the actual turning angle is larger than a change in the turning angle corresponding to the steering angle. The direction of change between the two is common.

As described above, with the control during rotation, even if the rotation operation on the steering wheel 18 is performed in the AP mode, the deviation decreases, which makes it possible to suppress an uncomfortable feeling in the steering operation at the start of the normal steering mode.

Figure 5A:
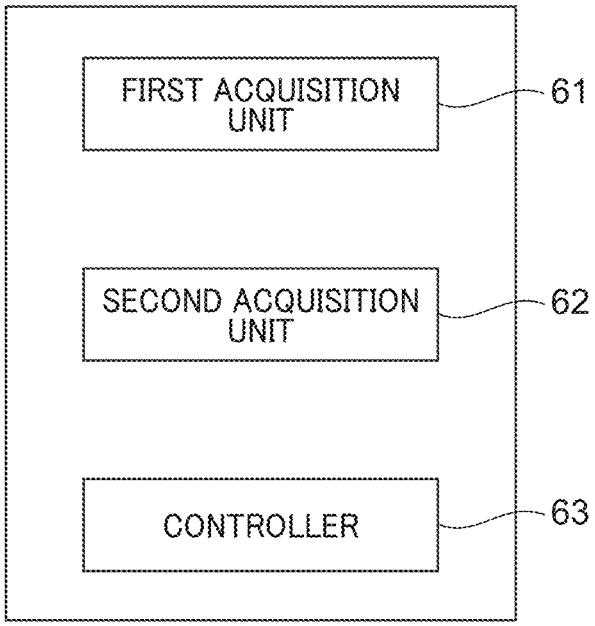
FIGS. 5A and 5B are diagrams respectively illustrating a first functional block for implementing control in a normal steering mode and a second functional block for implementing a return processing of returning a steering mode from an AP mode to the normal steering mode.
Figure 5B:
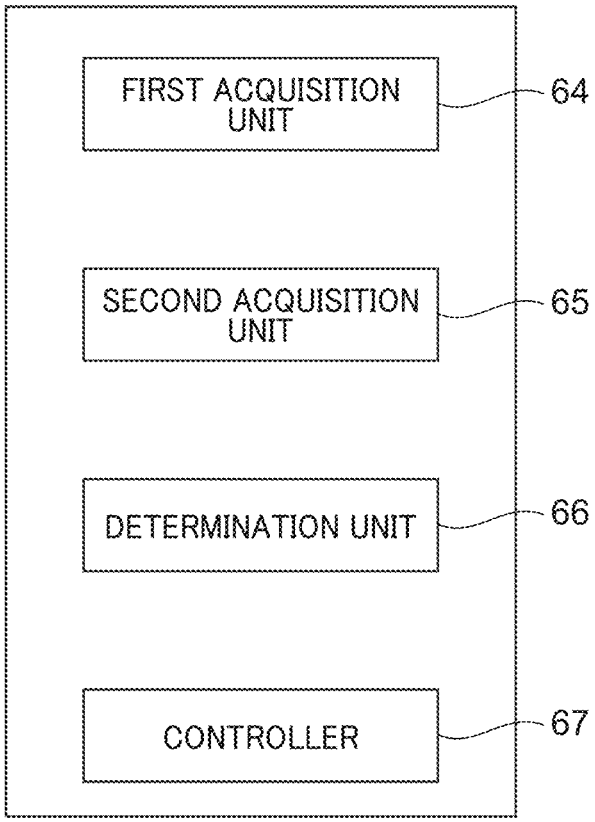

FIG. 5A is a diagram illustrating a first functional block for implementing control in the normal steering mode. FIG. 5B is a diagram illustrating a second functional block for implementing return processing of returning the steering mode from the AP mode to the normal steering mode. It is noted that it is not essential to provide both the functional blocks illustrated in FIGS. 5A and 5B, and the first functional block and/or the second functional block may be provided depending on control to be implemented.

The first functional block (in FIG. 5A) includes, as functional units, a first acquisition unit 61, a second acquisition unit 62, and a controller 63. The second functional block (in FIG. 5B) includes, as functional units, a first acquisition unit 64, a second acquisition unit 65, a determination unit 66, and a controller 67. The functional units of the first functional block and the second functional block are implemented mainly by cooperation among the components 31 to 37, the engine 16, and the controller 30.

First, the first functional block (in FIG. 5A) will be described. The function of the first acquisition unit 61 is implemented mainly by the rotation angle sensor 31 and the controller 30. The first acquisition unit 61 acquires the rotation angle position of the steering wheel 18 (steering angle) from the rotation angle sensor 31.

The function of the second acquisition unit 62 is implemented mainly by the changeover switch 59 and the controller 30. The second acquisition unit 62 acquires the start instruction of the AP mode from an operation signal of the changeover switch 59.

The function of the controller 63 is mainly implemented by the controller 30. The controller 63 performs a control to shift the steering mode to the AP mode in response to acquisition of the start instruction of the AP mode in the normal steering mode. In addition, the controller 63 performs a control to shift the steering mode to the normal steering mode in response to a change in the steering angle beyond the threshold angle TH in the AP mode. Further, the controller 63 does not switch the steering mode to the AP mode when the steering angle falls within the shift prohibition range θ13 or θ15 in a state in which the steering mode is in the normal steering mode. That is, in a case where a difference between the acquired steering angle and the first angle position θL is smaller than a first predetermined angle amount, or in a case where a difference between the acquired steering angle and the second angle position θR is smaller than a second predetermined angle amount, the controller 63 does not switch the steering mode to the AP mode even if the start instruction of the AP mode is issued.

Next, the second functional block (in FIG. 5B) will be described. The function of the first acquisition unit 64 is similar to the function of the first acquisition unit 61. The function of the second acquisition unit 65 is similar to the function of the second acquisition unit 62.

The function of the determination unit 66 is implemented mainly by the controller 30. The determination unit 66 determines whether the rotation of the steering wheel 18 is stopped based on the rotation angle position of the steering wheel 18 (steering angle) acquired by the first acquisition unit 64.

The function of the controller 67 is implemented mainly by the controller 30. In the returning processing described above, the controller 67 executes the above-described control during stop or the above-described control during rotation based on a determination of whether or not rotation of the steering wheel 18 is stopped and a relationship between the rotation direction of the steering wheel 18 and the actual turning angle.

Figure 6:
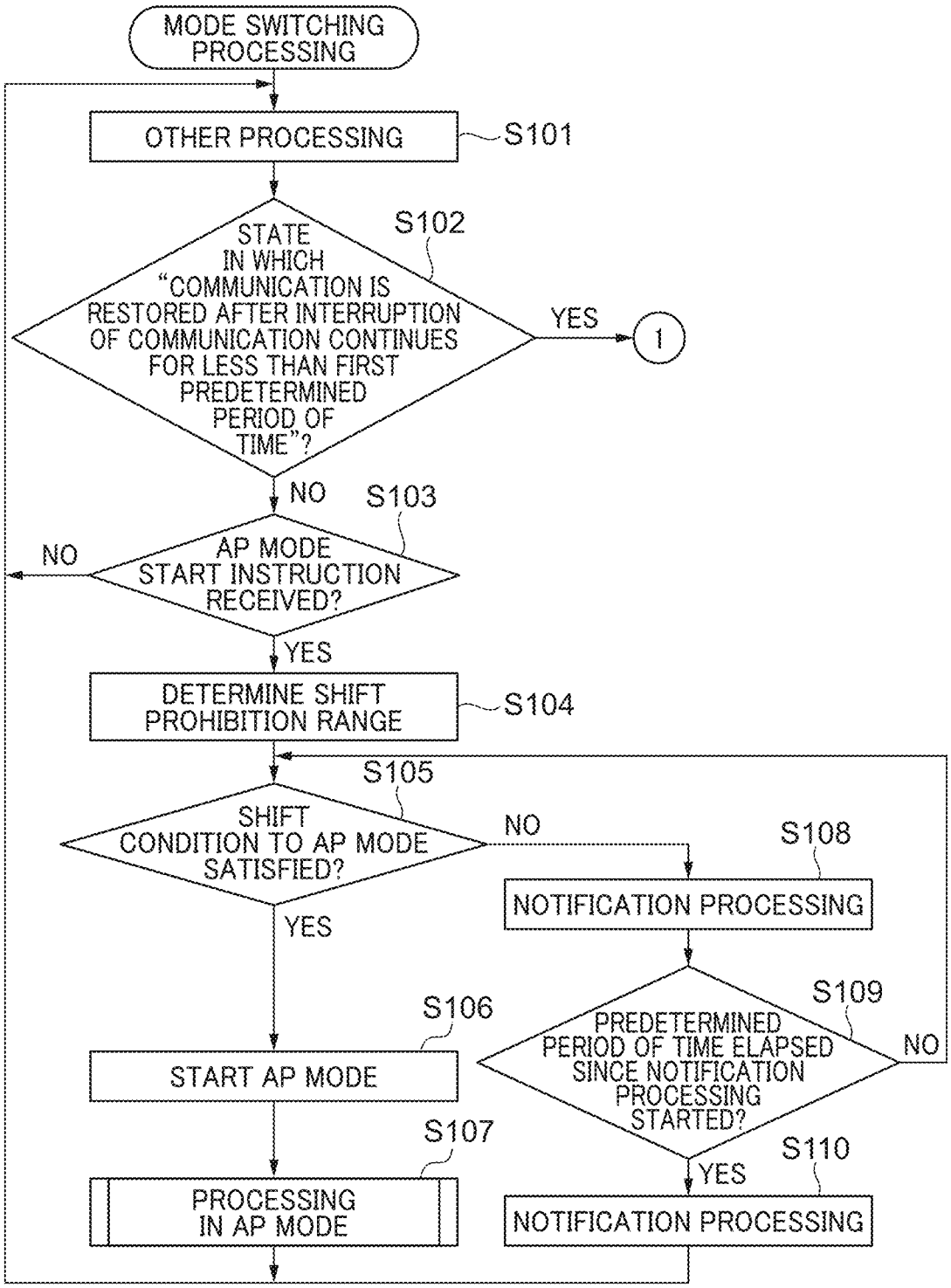
FIG. 6 is a flowchart of mode switching processing.

FIG. 6 is a flowchart of mode switching processing. The mode switching processing is implemented by the CPU 38 loading the program stored in the ROM 39 in the RAM 40 and executing the program. This processing is started, for example, when the steering system is started.

Figure 7:
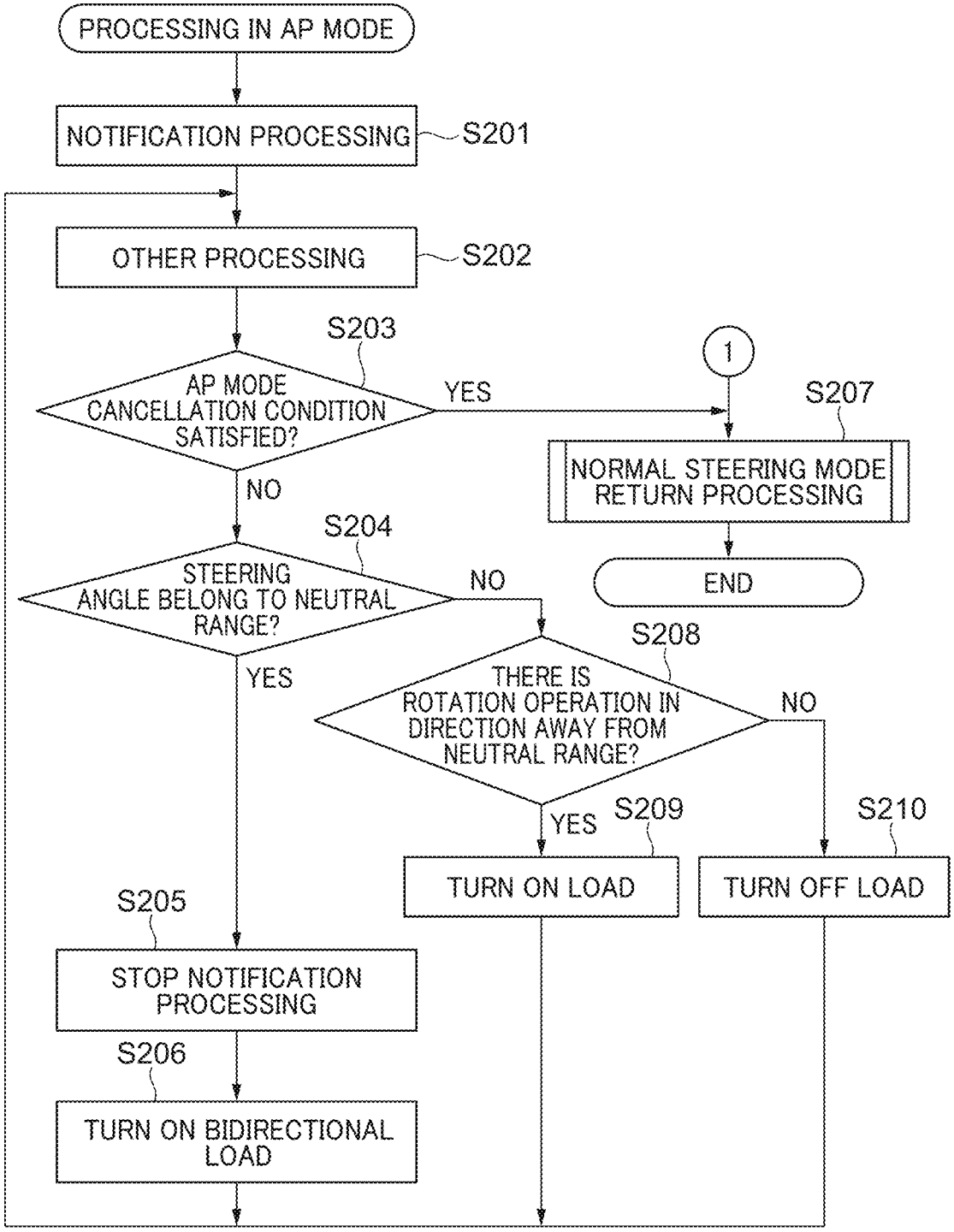
FIG. 7 is a flowchart of processes in the AP mode.
Figure 8:
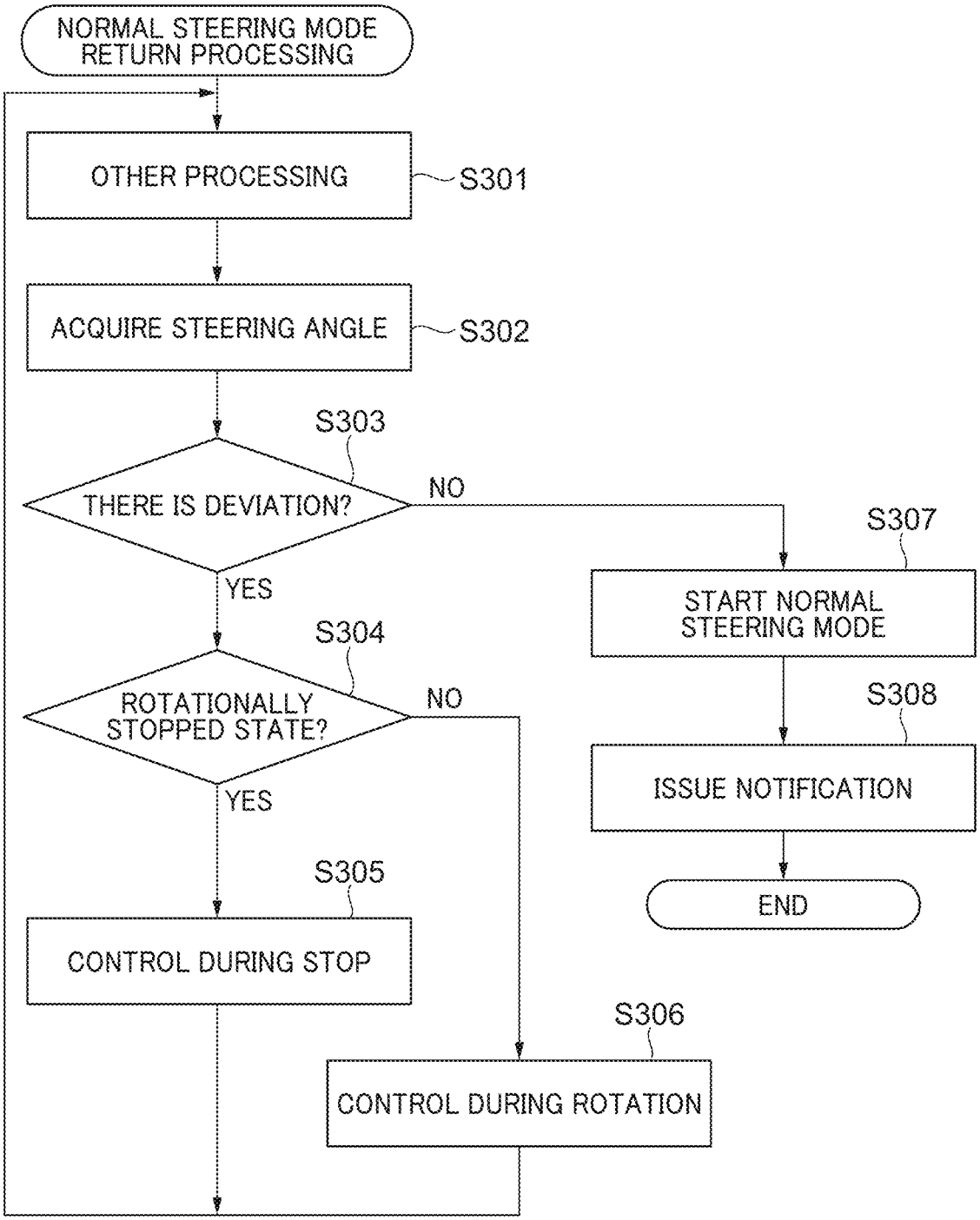
FIG. 8 is a flowchart of a normal steering mode return processing.

FIG. 7 is a flowchart of processing in the AP mode to be executed in step S107 of FIG. 6. FIG. 8 is a flowchart of the normal steering mode return processing to be executed in step S207 of FIG. 7. The mode switching processing will be described with reference to FIG. 4 as well.

Immediately after the mode switching processing in FIG. 6 is started, initialization is executed, and the steering mode is set to the normal steering mode (the time point TO in FIG. 4). In addition, communication with sensors and operators is established to enable acquisition of information and output of an instruction.

In step S101, the controller 30 executes "other processing". In the "other processing", the controller 30 executes a process such as starting clocking by a timer, establishing communication when communication is interrupted, and the like. In addition, when a forced termination instruction is input, the controller 30 may terminate the mode switching processing in FIG. 6.

In step S102, the controller 30 determines whether or not a current state is "a state in which communication is restored after interruption of communication continues for less than a first predetermined period of time (for example, one second)". For example, in the following case, the controller 30 determines "YES" in step S102: a case in which a current state enters a state in which "a detection result of (steering angle) the rotation angle position of the steering wheel 18 by the rotation angle sensor 31 cannot be acquired" or enters a state in which "the actual turning angle cannot be acquired from the turning angle sensor 32", and then the state returns to a state in which these pieces of information (the detection result and the actual turning angle, respectively) can be acquired before the first predetermined period of time (for example, one second) has elapsed. In such a situation in which YES is determined in step S102, there is a possibility that deviation occurs between the steering angle and the actual turning angle. Therefore, in order to execute the return processing, the controller 30 advances the processing to step S207 in FIG. 7 (normal steering mode return processing in FIG. 8) (the time point T3). It is noted that, when the state in which the actual turning angle and/or the steering angle cannot be acquired continues for the first predetermined period of time or longer due to continuation of interruption of communication or the like, the controller 30 may issue a notification of an error and stop the vessel.

On the other hand, in a case where "the state in which communication is restored after interruption of communication continues for less than the first predetermined period of time" is not satisfied, the controller 30 advances the processing to step S103. In step S103, the controller 30 determines whether or not the start instruction of the AP mode has been acquired by receiving an operation signal from the changeover switch 59 or the like. In a case where the start instruction of the AP mode has not been acquired, the controller 30 returns the processing to step S101. In a case where the start instruction of the AP mode has been acquired, the controller 30 advances the processing to step S104.

In step S104, the controller 30 determines the shift prohibition ranges θ13 and θ15. As an example, the controller 30 determines the first predetermined angle amount and the second predetermined angle amount based on at least one of the vessel speed detected by the hull speed sensor among the various sensors 33 and the engine rotation speed detected by the engine rotation speed sensor among the various sensors 33. As a result, the shift prohibition range θ13, which is a range between the first angle position θL and a portion reached by rotating the first angle position θL in the right rotation direction by the first predetermined angle amount, is determined. In addition, the shift prohibition range θ15, which is a range between the second angle position θR and a portion reached by rotating the second angle position θR in the left rotation direction by the second predetermined angle amount, is determined. For example, the shift prohibition ranges θ13 and θ15 are wider as the vessel speed is higher, and the shift prohibition ranges θ13 and θ15 are wider as the engine rotation speed is higher.

It is noted that, in the present example embodiment, the shift prohibition ranges θ13 and θ15 are dynamically changed; however, the shift prohibition ranges θ13 and θ15 may be fixed values. In this case, the processing of step S104 may be omitted.

In step S105, the controller 30 determines whether or not the shift condition to the AP mode is satisfied. For example, the shift condition to the AP mode means that the current steering angle does not belong to the shift prohibition range θ13 or θ15 and belongs to the shiftable range. That is, in a case where a difference between the acquired steering angle and the first angle position θL is greater than or equal to the first predetermined angle amount, and a difference between the acquired steering angle and the second angle position θR is greater than or equal to the second predetermined angle amount, the steering angle belongs to the shiftable range and, as such, the shift condition to the AP mode is satisfied. It is noted that, in addition thereto, the shift condition may be that a yaw rate acquired by detection signals from the posture sensor of the various sensors 33 falls within a predetermined value.

In a case where the shift condition to the AP mode is not satisfied, the controller 30 advances the processing to step S108 and executes notification processing. This notification processing may be executed, for example, by at least one of display of a message using the display unit 36, lighting indication using an LED not illustrated, and a voice message using a sound generator not illustrated (which can be similarly applied to notification processing to be described below). In this notification processing, for example, the controller 30 issues a notification that the steering mode cannot be shifted to the AP mode. Further, the controller 30 may issue a notification to return the steering wheel 18 to the neutral position. When the vessel user rotationally operates the steering wheel 18 toward the neutral position in response to a notification issued to prompt to return the steering wheel 18 to the neutral position, there is a possibility that the steering angle deviates from the shift prohibition range θ13, θ15 and belongs to the shiftable range.

In step S109, the controller 30 determines whether or not a predetermined period of time (second predetermined period of time) has elapsed from the start of the notification processing in the first step S108. In a case where the second predetermined period of time has not elapsed, the controller 30 returns the processing to step S105, and in a case where the second predetermined period of time has elapsed, the controller 30 advances the processing to step S110.

In step S110, since the shift condition to the AP mode is not satisfied even after the second predetermined period of time has elapsed, the controller 30 executes notification processing and then returns the processing to step S101. In the notification processing in step S110, the controller 30 issues a notification that the steering mode could not be shifted to the AP mode. Further, the controller 30 may issue a notification to return the steering wheel 18 to the neutral position. When the vessel user rotationally operates the steering wheel 18 toward the neutral position in response to a notification issued to prompt to return the steering wheel 18 to the neutral position, there is a possibility that the steering angle deviates from the shift prohibition range θ13, θ15 and belongs to the shiftable range. In this case, there is a possibility that the steering mode can be shifted to the AP mode when the vessel user instructs the start of the AP mode again in the processing after the resumed (second and subsequent) step S101.

In a case where the controller 30 determines, in step S105, that the shift condition to the AP mode is satisfied, the processing proceeds to step S106. In a case where the shift condition to the AP mode is satisfied during the loop of steps S105, S108, and S109, the controller 30 advances the processing from step S105 to step S106. For example, when the vessel user rotationally operates the steering wheel 18 toward the neutral position and the steering angle belongs to the shiftable range, the processing can proceed to step S106. In this case, the vessel user can shift the steering mode to the AP mode without instructing the start of the AP mode again. It is noted that it is not essential to provide steps S108 and S109.

In step S106, the controller 30 starts the AP mode (the time point T1). In step S107, the controller 30 executes the processing in the AP mode (in FIG. 7) (the time point T1 to the time point T3). After step S107, the controller 30 returns the processing to step S101.

In step S201 of FIG. 7, the controller 30 starts notification processing. In this notification processing, for example, the controller 30 issues a notification that the steering mode has shifted to the AP mode. Further, the controller 30 may issue a notification to return the steering wheel 18 to the neutral position.

In step S202, the controller 30 executes "other processing". In the "other processing" here, the controller 30 acquires various detection values such as a steering angle, and starts clocking by a timer, and the like. The controller 30 sets/updates the steering angle acquired this time as a reference position. In the "other processing", the controller 30 further executes processing such as establishing communication in a case where communication is interrupted. It is noted that, when the communication interruption state continues for the first predetermined period of time or longer, the controller 30 may issue a notification of an error and stop the vessel. In addition, when a forced termination instruction is input, the controller 30 may terminate the mode switching processing (in FIG. 6).

In step S203, the controller 30 determines whether or not an AP mode cancellation condition is satisfied. As described above, one of the AP mode cancellation conditions includes that the steering angle has been changed beyond the threshold angle TH. In addition, one of the AP mode cancellation conditions includes that the changeover switch 59 is operated (pressed again in the AP mode). Therefore, the AP mode cancellation condition is satisfied when the steering angle is changed from the reference position set in step S202 beyond the threshold angle TH or when the changeover switch 59 is pressed. This is because, in such a case, it is considered that there is an intention of performing manual steering. In addition, operations of other operators, such as the left switch 53 and the right switch 54, may also be included in one of the AP mode cancellation conditions.

In a case where the AP mode cancellation condition is satisfied, the controller 30 advances the processing to step S207 (the time point T3), executes normal steering mode return processing (in FIG. 8), and then terminates the processing in the AP mode (in FIG. 7). On the other hand, in a case where the AP mode cancellation condition is not satisfied, the controller 30 advances the processing to step S204.

As described above, when the vessel user returns the steering wheel 18 to the neutral position before the AP mode cancellation condition is satisfied, it is expected that the deviation between the steering angle and the actual turning angle at the time when the steering mode returns to the normal steering mode becomes small. As a result, it is possible to prevent a sudden change in the turning angle at the time of returning to the normal steering mode and to suppress an uncomfortable feeling in the steering operation. Furthermore, since when the steering wheel 18 is located at the neutral position, the current position of the operators on the steering wheel 18 can be easily properly understood and, as such, the switches and the like can be easily operated in the AP mode. For example, since the left switch 53 and the right switch 54 are respectively located on the left and right positions which are positions at which the left switch 53 and the right switch 54 should be originally located, an operation is easily performed by the vessel user.

In step S204, the controller 30 determines whether or not the steering angle acquired last belongs to a neutral range (a predetermined range). Here, the neutral range is a range of a predetermined angle from the neutral position (for example, ±10°) and is determined and acquired in advance. In a case where the steering angle acquired last belongs to the neutral range, the controller 30 advances the processing to step S205, and stops the notification processing which started in step S201 and has been continued. This is because when the steering angle is located in the neutral range, the deviation between the steering angle and the actual turning angle at the time of returning to the normal steering mode is considered to be small.

In step S206, the controller 30 turns on a bidirectional load. Specifically, the controller 30 drives the load generation unit 35 to generate a load (friction) on a rotation operation of the steering wheel 18, regardless of a rotation direction. As a result, since a load acts on the steering wheel 18 performing the rotation operation thereof when the steering wheel 18 within the neutral range is rotated in either the right or left direction, there is an effect of urging the vessel user tactilely to keep the steering wheel 18 in the neutral range. It is noted that, when the processing exits from the AP mode processing, the bidirectional load is cancelled. After step S206, the controller 30 returns the processing to step S202.

It is noted that, in step S206, the load may be controlled to be larger than a load to be applied when the steering angle does not belong to the neutral range. Therefore, the load to be applied when the steering angle does not belong to the neutral range may be greater than zero.

In step S204, in a case where it is determined that the steering angle acquired last does not belong to the neutral range, the controller 30 advances the processing to step S208. In step S208, the controller 30 determines whether or not there is a rotation operation of the steering wheel 18 (steering rotation operation) in a direction away from the neutral range. This determination is performed by comparing a value of the steering angle acquired last time with a value of the steering angle acquired this time. Then, in a case where the controller 30 determines that the steering rotation operation is performed in the direction away from the neutral range, the controller 30 advances the processing to step S209. In a case where the controller 30 determines that the steering rotation operation in the direction away from the neutral range has not been performed, the controller 30 advances the processing to step S210.

In step S209, the controller 30 turns on the load. Specifically, the controller 30 drives the load generation unit 35 to generate the load acting on the steering wheel 18 performing the rotation operation thereof in the direction away from the neutral range. On the other hand, in step S210, the controller 30 turns off the load. Therefore, the controller 30 does not generate the load acting on the steering wheel 18 performing the rotation operation thereof. Such processing of so-called "unidirectional braking" has an effect of tactilely urging the vessel user to keep the steering wheel 18 in the neutral range.

It is noted that, in step S209, when the steering rotation operation is performed in the direction away from the neutral range, the load may be controlled to be larger than that to be applied when the steering rotation operation is performed in a direction approaching the neutral range. Therefore, the load to be applied when the steering rotation operation is performed in the direction approaching the neutral range may be greater than zero.

After step S209 or S210, the controller 30 returns the processing to step S202.

In step S301 of FIG. 8, the controller 30 executes "other processing". In this "other processing" here, the controller 30 acquires various detection values such as the actual turning angle, and starts clocking by a timer, and the like. In addition, the controller 30 waits for a certain period of time in order to secure a steering angle acquisition period used to determine whether the steering wheel 18 is in the rotationally stopped state (step S304 described below). In addition, the controller 30 further executes processing such as establishing communication in a case where communication is interrupted. It is noted that, when the communication interruption state continues for the first predetermined period of time or longer, the controller 30 may issue a notification of an error and stop the vessel. In addition, when a forced termination instruction is input, the controller 30 may terminate the mode switching processing (in FIG. 6).

In step S302, the controller 30 acquires the steering angle. In step S303, the controller 30 determines whether or not there is a deviation (a predetermined difference or more) between the acquired steering angle and the actual turning angle. Then, in a case where there is the deviation, the controller 30 advances the processing to step S304.

In step S304, the controller 30 determines whether or not the steering wheel 18 is in the rotationally stopped state. This determination is performed by comparing a previous value of the steering angle with a current value of the steering angle, wherein it is determined that the rotation is stopped (in the rotationally stopped state) in a case where a difference between the previous value of the steering angle and the current value of the steering angle is less than a predetermined angle difference. Then, the controller 30 advances the processing to step S305 in a case where the steering wheel 18 is in the rotationally stopped state, and advances the processing to step S306 in a case where the steering wheel 18 is not stopped (is not in the rotationally stopped state).

In step S305, as described above, the controller 30 executes the control during stop (first control) (the time points T5 to T6). Two methods described below are conceivable for the control during stop, and any one of the two methods may be used. It is noted that which method to be used may be determined by the vessel user.

First, in the first method of the control during stop, the controller 30 determines, based on an amount of deviation, a change amount Δ per unit period of time of the turning angle of the outboard motor 15, wherein the change amount Δ is used when the turning actuator 37 is controlled so as to reduce the deviation. For example, the larger the amount of deviation between the steering angle and the actual turning angle, the faster the controller 30 changes the turning angle of the outboard motor 15. At that time, the controller 30 may determine the change amount Δ so that the deviation is eliminated within a target period of time (for example, within 10 seconds). By determining the change amount Δ in this manner, it is possible to eliminate an uncomfortable feeling in the steering operation at an appropriate speed and within the target period of time.

In a second method of the control during stop, the controller 30 determines the change amount Δ based on at least one of the vessel speed and the engine rotation speed. For example, the controller 30 sets the change amount Δ to a smaller value as the vessel speed or the like is faster. As a result, it is possible to prevent a sudden change in the turning angle at the time of returning to the normal steering mode without requiring a rotation operation, which makes it possible to smoothly perform the shift to the normal steering mode.

It is noted that the controller 30 may determine the change amount Δ based on at least one of the amount of deviation, the vessel speed, and the engine rotation speed, without determining the target period of time.

In step S306, as described above, the controller 30 executes the control during rotation (second control) (the time points T3 to T5). When the steering wheel 18 rotates in a direction in which the turning angle corresponding to the steering angle moves away from the actual turning angle, the controller 30 changes the actual turning angle by a value obtained by correcting the turning angle corresponding to the rotation amount of the steering wheel 18 to a larger value. When the steering wheel 18 rotates in a direction in which the turning angle corresponding to the steering angle approaches the actual turning angle, the controller 30 changes the actual turning angle by a value obtained by correcting the turning angle corresponding to the rotation amount of the steering wheel 18 to a smaller value.

It is noted that a correction ratio for correcting the turning angle corresponding to the rotation amount of the steering wheel 18 may be a fixed value. Alternatively, the correction ratio may be determined based on at least one of the amount of deviation, the vessel speed, and the engine rotation speed. As a result, even when the steering wheel 18 is rotationally operated, the deviation decreases, thus making it possible to prevent a sudden change in the turning angle at the time of returning to the normal steering mode, and to smoothly perform the shift to the normal steering mode.

After step S305 or S306, the controller 30 returns the processing to step S301.

In a case where the controller 30 determines, in step S303, that there is no deviation between the acquired steering angle and the actual turning angle, the processing proceeds to step S307. In step S307, the controller 30 starts the normal steering mode (the time point T6). Therefore, a case in which the processing proceeds to step S307 after step S304 is a case in which the normal steering mode is started after the deviation is eliminated by the control to reduce the deviation. Therefore, it is possible to suppress an uncomfortable feeling in the steering operation at the start of the normal steering mode.

When the controller 30 starts the normal steering mode, the controller 30 issues, in step S308, a notification that normal steering mode is started. As a result, the vessel user can be notified of the return to the normal steering mode. After step S308, the controller 30 ends the normal steering mode return processing (in FIG. 8).

It is noted that, according to the normal steering mode return processing, in a case where after the control during stop is started, the steering wheel 18 starts rotating before the deviation is eliminated, the control during stop is terminated and the control during rotation is executed (S305→S304 of the next loop→S306). On the other hand, in a case where after the control during rotation is started, the steering wheel 18 stops the rotation thereof before the deviation is eliminated, the control during rotation is terminated and the control during stop is executed (S306→S304 of the next loop→S305). Therefore, even when the steering wheel 18 is repeatedly rotated and stopped rotating, it is possible to suppress an uncomfortable feeling in the steering operation at the start of the normal steering mode by eliminating the deviation.

According to the present example embodiment, for the steering wheel 18, a rotatable angle in the left rotation direction is limited to the first angle position OL, and a rotatable angle in the right rotation direction is limited to the second angle position θR. The controller 30 performs a control to shift the steering mode to the normal steering mode in response to a change in the steering angle beyond the threshold angle TH in the AP mode (S203→S207). In the normal steering mode, the controller 30 switches the steering mode to the AP mode when the steering angle is within the shiftable range (the angle θ14 and the angle θ16) and does not switch the steering mode to the AP mode when the steering angle falls within the shift prohibition ranges θ13 and θ15 (S105). As a result, in the AP mode, a state in which the rotation operation beyond the threshold angle TH is possible is secured anytime. Therefore, in the AP mode, the vessel user can anytime cancel the AP mode by performing a rotation operation on the steering wheel 18.

In addition, in a case where the start instruction of the AP mode is acquired, and the AP shift condition is not satisfied and the steering mode is not shifted to the AP mode, the controller 30 issues a notification of that matter (S108 and S110), so that the vessel user can be notified that the steering mode cannot be shifted to the AP mode. At this time, the controller 30 issues a notification to instruct the vessel user to return the steering wheel 18 to the neutral position, and thereafter, when the AP shift condition is satisfied within the second predetermined period of time, the steering mode is shifted to the AP mode. Therefore, when the steering wheel 18 is positioned in the shiftable range within the second predetermined period of time, the controller 30 can shift the steering mode to the AP mode even if there is no start instruction again (S109→S105→S106).

In addition, since the shift prohibition range is determined based on at least one of the vessel speed and the engine rotation speed (S104), the shift to the AP mode can be smoothly performed.

In addition, when the vessel user is notified that the steering mode has been shifted to the AP mode, the operator is notified to return the steering wheel 18 to the neutral position (S201), thus making it possible to reduce the deviation between the turning angle corresponding to the steering angle and the actual turning angle of the outboard motor 15. Therefore, it is possible to suppress an uncomfortable feeling in the steering operation at the time of returning to the normal steering mode. Moreover, the operators disposed on the steering wheel 18 can be easily operated in the AP mode.

Further, in the AP mode, when the steering wheel 18 is located in the neutral range, a load to be applied on the steering wheel 18 performing the rotation operation thereof is controlled to be larger than a load to be applied when the steering wheel is not located in the neutral range (S206), so that the steering wheel 18 is easily maintained in the neutral range.

Additionally, in the AP mode, when the steering wheel 18 is rotationally operated in the direction away from the neutral range, the generated load is increased as compared with a case in which the steering wheel is rotationally operated in the direction approaching the neutral range (S209 and S210). Accordingly, it is possible to tactilely urge the vessel user to return the steering wheel 18 to the neutral range.

According to the present example embodiment, in the return processing for shifting the steering mode from the AP mode to the normal steering mode, the controller 30 controls the turning actuator 37 so as to reduce the deviation between the turning angle corresponding to the steering angle and the actual turning angle of the outboard motor 15 when the steering wheel 18 is in the rotationally stopped state (control during stop (first control); S305).

As a result, even if the steering operation is not performed, the deviation becomes small by the time of returning to the normal steering mode, and therefore it possible to suppress an uncomfortable feeling in the steering operation after the AP mode is cancelled.

In addition, in the control during stop (S305), the change amount Δ per unit period of time of the turning angle of the outboard motor 15 is determined based on the amount of deviation, which makes it possible to eliminate an uncomfortable feeling in the steering operation at an appropriate speed. In addition, the change amount Δ is determined so as to eliminate the deviation within the target period of time, which makes it possible to eliminate the uncomfortable feeling in the steering operation within the target period of time.

Alternatively, in the control during stop (S305), the change amount Δ is determined based on at least one of the vessel speed and the engine rotation speed, which makes it possible to smoothly perform the shift to the normal steering mode.

Further, after the normal steering mode return processing (in FIG. 8) is started, the normal steering mode is started while the normal steering mode return processing is terminated, when the deviation is eliminated (S307), which makes it possible to suppress the uncomfortable feeling in the steering operation at the start of the normal steering mode.

Additionally, when the normal steering mode is started, that matter is notified (S308), and the vessel user can be notified of the return to the normal steering mode.

Further, when the steering wheel 18 is not in the rotationally stopped state, the controller 30 performs the control during rotation (second control; S306). In the control during rotation, when the steering wheel 18 rotates in a direction in which the turning angle corresponding to the steering angle is away from/approaches the actual turning angle, the controller 30 changes the actual turning angle by a value obtained by correcting the turning angle corresponding to the rotation amount of the steering wheel 18 to a larger/smaller value. As a result, the shift to the normal steering mode can be smoothly performed.

Further, in the normal steering mode return processing even when the steering wheel 18 is repeatedly rotated and stopped rotating, the controller 30 switches the control between the control during stop and the control during rotation, thus appropriately eliminating the deviation (S304 to S306). As a result, it is possible to suppress an uncomfortable feeling in the steering operation at the start of the normal steering mode.

In addition, the normal steering mode return processing (in FIG. 8) is started in response to a cancellation instruction of the AP mode by operation on the changeover switch 59 or in response to a change in the steering angle beyond the threshold angle TH (S203→S207). Therefore, in a situation where the vessel user has an intention to perform manual steering and there is a possibility that a deviation occurs, it is possible to start the return processing and reduce the deviation.

In addition, the normal steering mode return processing (FIG. 8) is started in response to the return to a state in which both the steering angle and the actual turning angle can be acquired before the lapse of the first predetermined period of time after a state where the steering angle and/or the actual turning angle cannot be acquired in the normal steering mode (S102→S207). As a result, it is possible to start the return processing in a situation where there is a possibility that deviation occurs and to reduce the deviation.

Although the present invention has been described in detail based on the example embodiments thereof, the present invention is not limited to these specific example embodiments, and various forms without departing from the gist of the present invention are also included in the present invention.

The present invention can also be implemented by performing processing in which a program to implement one or more functions of the above-described example embodiments is supplied to a system or a device via a network or a non-transitory storage medium, and one or more processors of a computer of the system or the device read and execute the program. The above program and the storage medium storing the above program are example embodiments of the present invention. Further, the present invention can also be implemented by a circuit (for example, ASIC) to implement one or more functions.

It is noted that the propulsion device is not limited to one having an engine as power, and an electric motor as power may be used for the propulsion device.

It is noted that the marine vessel to which the present invention is applied may be a marine vessel equipped with an inboard motor or an inboard/outboard motor, or a jet boat.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A steering control device for a marine vessel including a steering wheel having a rotatable angle in a left rotation direction limited to a first angle position, and a rotatable angle in a right rotation direction limited to a second angle position, the marine vessel including steering modes including a normal steering mode and an automatic steering mode, the steering control device comprising:

at least one memory to store a set of instructions; and at least one processor configured or programmed to execute the set of instructions to:

acquire a rotation angle position of the steering wheel;

acquire a start instruction of the automatic steering mode to allow the marine vessel to be automatically steered without depending on a rotation operation of the steering wheel and automatically steered without depending on input by a vessel user; and perform a control operation to shift the steering mode to the automatic steering mode in response to acquisition of the start instruction in the normal steering mode, and to shift the steering mode to the normal steering mode in response to a change in the rotation angle position of the steering wheel beyond a threshold angle in the automatic steering mode; wherein during the control operation, in the normal steering mode, the at least one processor is configured or programmed to not shift the steering mode to the automatic steering mode even when the start instruction is acquired in a case where a difference between the acquired rotation angle position of the steering wheel and the first angle position is smaller than a first predetermined angle amount, or in a case where a difference between the acquired rotation angle position of the steering wheel and the second angle position is smaller than a second predetermined angle amount.

2. The steering control device according to claim 1, wherein the at least one processor is further configured or programmed to execute the set of instructions to:

in a case where the start instruction is acquired and the steering mode is not shifted to the automatic steering mode, provide notification that the steering mode is not shifted to the automatic steering mode.

3. The steering control device according to claim 2, wherein the at least one processor is further configured or programmed to execute the set of instructions to:

when providing notification that the steering mode is not shifted to the automatic steering mode, issue a notification to return the steering wheel to a neutral position between the first angle position and the second angle position.

4. The steering control device according to claim 3, wherein the at least one processor is further configured or programmed to execute the set of instructions to:

shift the steering mode to the automatic steering mode in a case in which the difference between the acquired rotation angle position of the steering wheel and the first angle position is equal to or greater than the first predetermined angle amount and the difference between the acquired rotation angle position of the steering wheel and the second angle position is equal to or greater than the second predetermined angle amount within a predetermined period of time after issuing the notification to return the steering wheel to the neutral position.

5. The steering control device according to claim 1, wherein the at least one processor is further configured or programmed to execute the set of instructions to:

determine the first predetermined angle amount and the second predetermined angle amount based on at least one of a vessel speed and a rotation speed of a drive source in a propulsion device to propel the marine vessel.

6. The steering control device according to claim 1, wherein the at least one processor is further configured or programmed to execute the set of instructions to:

in a case where the steering mode is shifted to the automatic steering mode, provide notification that the steering mode is shifted to the automatic steering mode.

7. The steering control device according to claim 6, wherein the at least one processor is further configured or programmed to executes the set of instructions to:

when notifying that the steering mode is shifted to the automatic steering mode, issue a notification to return the steering wheel to a neutral position between the first angle position and the second angle position.

8. The steering control device according to claim 1, further comprising:

a load generator to generate a load acting on the steering wheel performing the rotation operation thereof; wherein the at least one processor is further configured or programmed to execute the set of instructions to:

after the steering mode is shifted to the automatic steering mode, in a case where the steering wheel is located in a predetermined range having a neutral position as a reference position, which is located between the first angle position and the second angle position, control the load generator so that a load acting on the steering wheel performing the rotation operation thereof becomes larger than that in a case where the steering wheel is not located in the predetermined range.

9. The steering control device according to claim 1, further comprising:

a load generator to generate a load acting on the steering wheel performing the rotation operation thereof; wherein the at least one processor is further configured or programmed to execute the set of instructions to:

after the steering mode is shifted to the automatic steering mode, in a case where the steering wheel is rotationally operated in a direction away from a predetermined range having a neutral position as a reference position, which is located between the first angle position and the second angle position, control the load generator so that a load to be generated becomes larger than that in a case where the steering wheel is rotationally operated in a direction approaching the predetermined range.

10. The steering control device according to claim 1, wherein the rotatable angle in the left rotation direction plus the rotatable angle in the right rotation direction is less than 360°.

11. A marine vessel comprising:

a steering control device;

a steering wheel having a rotatable angle in a left rotation direction limited to a first angle position, and a rotatable angle in a right rotation direction limited to a second angle position, and including steering modes including a normal steering mode and an automatic steering mode;

at least one memory to store a set of instructions; and at least one processor configured or programmed to execute the set of instructions to:

acquire a rotation angle position of the steering wheel;

acquire a start instruction of the automatic steering mode to allow the marine vessel to be automatically steered without depending on a rotation operation of the steering wheel and automatically steered without depending on input by a vessel user; and perform a control operation to shift the steering mode to the automatic steering mode in response to acquisition of the start instruction in the normal steering mode, and to shift the steering mode to the normal steering mode in response to a change in the rotation angle position of the steering wheel beyond a threshold angle in the automatic steering mode; wherein during the control operation, in the normal steering mode, the at least one processor is configured or programmed to not shift the steering mode to the automatic steering mode even when the start instruction is acquired in a case where a difference between the acquired rotation angle position of the steering wheel and the first angle position is smaller than a first predetermined angle amount, or in a case where a difference between the acquired rotation angle position of the steering wheel and the second angle position is smaller than a second predetermined angle amount.

12. The marine vessel according to claim 11, wherein the rotatable angle in the left rotation direction plus the rotatable angle in the right rotation direction is less than 360°.

13. A steering control method for a marine vessel including a steering wheel having a rotatable angle in a left rotation direction limited to a first angle position, and a rotatable angle in a right rotation direction limited to a second angle position, the marine vessel including steering modes including a normal steering mode and an automatic steering mode, the steering control method comprising:

acquiring a rotation angle position of the steering wheel;

acquiring a start instruction of the automatic steering mode to allow the marine vessel to be automatically steered without depending on a rotation operation of the steering wheel and automatically steered without depending on input by a vessel user; and performing a control operation to shift the steering mode to the automatic steering mode in response to acquisition of the start instruction in the normal steering mode, and to shift the steering mode to the normal steering mode in response to a change in the rotation angle position of the steering wheel beyond a threshold angle in the automatic steering mode; wherein during the control operation, in the normal steering mode, controlling so as not to shift the steering mode to the automatic steering mode even when the start instruction is acquired in a case where a difference between the acquired rotation angle position of the steering wheel and the first angle position is smaller than a first predetermined angle amount, or in a case where a difference between the acquired rotation angle position of the steering wheel and the second angle position is smaller than a second predetermined angle amount.

14. The steering control method according to claim 13, wherein the rotatable angle in the left rotation direction plus the rotatable angle in the right rotation direction is less than 360°.

* * * * *